US006019170A

United States Patent [19]

Yokoya et al.

[11] Patent Number: 6,019,170

[45] Date of Patent: Feb. 1, 2000

[54] SPACER FOR HEAT EXCHANGERS, ELEMENT FOR HEAT EXCHANGERS, AND HEAT EXCHANGER

[75] Inventors: Hisao Yokoya; Kenzo Takahashi; Hidemoto Arai, all of Tokyo, Japan

[73] Assignee: Mitsubishi Denki Kabushiki Kaisha, Tokyo, Japan

[21] Appl. No.: 08/997,592

[22] Filed: Dec. 23, 1997

[51] Int. Cl.[7] ..... F28F 3/00

[52] U.S. Cl. ..... 165/166; 165/905

[58] Field of Search ..... 165/166, 165, 165/167, 905

[56] References Cited

U.S. PATENT DOCUMENTS

| | | | |
|---|---|---|---|
| 3,862,280 | 1/1975 | Polovina | 261/112.2 |
| 3,925,167 | 12/1975 | Rodgers | 165/166 X |
| 4,102,721 | 7/1978 | Carey, Jr. | 156/79 |
| 4,616,695 | 10/1986 | Takahashi et al. | 165/166 X |
| 4,670,300 | 6/1987 | Stewart, Jr. | 427/115 |
| 5,248,454 | 9/1993 | Thomas | 261/112.2 |

FOREIGN PATENT DOCUMENTS

| | | |
|---|---|---|
| 19990 | 6/1972 | Japan . |
| 1054 | 1/1979 | Japan . |
| 25476 | 4/1992 | Japan . |
| 194093 | 7/1994 | Japan . |
| 190666 | 7/1995 | Japan . |
| 219676 | 8/1996 | Japan . |

*Primary Examiner*—Leonard Leo

[57] ABSTRACT

A spacer for heat exchangers comprising a plate for forming and maintaining a first passage and a second passage which carry out heat exchange therebetween; and the plate made of a material obtainable by mixing a fibrous material having a softening point and a resin material having a lower softening point than the fibrous material, followed by sheeting the mixture.

34 Claims, 4 Drawing Sheets

SPACER FOR HEAT EXCHANGERS, ELEMENT FOR HEAT EXCHANGERS, AND HEAT EXCHANGER

BACKGROUND OF THE INVENTION

1. Field of the Invention

The present invention relates to a heat exchanger, a spacer therefor and a partition therefor, which are used in a ventilation system with a heat exchanger wherein supplying fresh outdoor air and exhausting indoor air are simultaneously carried out to perform heat exchange between the supply air and the exhaust air, and in an air conditioning machine (total heat exchanging system for supply air and exhaust air) in an air conditioning machine room of e.g. a building.

2. Discussion of Background

Recent development in thermal insulation and airtightness for improving air conditioning and heating effects has given added importance to ventilation in a living space. It is effective to carry out heat exchange between supply air and exhaust air for ventilation without reducing the air conditioning and heating effects. In order to cope with such requirement, there have been known fixed ventilation systems with a heat exchanger which have been disclosed in e.g. JP-B-4719990 and JP-B-541054.

The conventional heat exchangers as mentioned above have such a structure that flat partitions 20 and corrugated spacers 21 are alternately layered as shown in a perspective view of FIG. 8, and that the respective spacers 21 are arranged to be perpendicular to their adjoined spacers in the layering process so as to provide a passage 22 for supply air and a passage 23 for exhaust air. In this Figure, an arrow indicated by A designates a supply airflow, and an arrow indicated by B designates an exhaust airflow. For example, when out door air in winter (fresh but cold air) passes through the passage 22 as the supply air, and when indoor heated air (contaminated but warm air) passes through the passage 23, as the exhaust air, the supply air and exhaust air carry out heat exchange through the partitions 20. The supplied air is heated by the heat exchange and is supplied indoors, and the exhaust air is cooled by the heat exchange and is exhausted outdoors.

In the case of total heat exchangers, the partitions 20 are made of e.g. converted paper dealt with a water-soluble polymer or a chemical agent (a material having a vapor permeability and a gas impermeability for e.g. air and carbon dioxide, (containing an absorbent, as disclosed in e.g. JP-A-542277. On the other hand, the spacers 21 are made of paper, giving importance to strength, workability and similarity to the partitions (expansion and contraction, and adhesion due to humidity). Use of these partitions and spacers can realize a high total heat exchange effectiveness.

In some of sensible heat exchangers, the partitions 20 and the spacers 21 have been made of a resin film. Such kind of sensible heat exchangers are constructed by joining a corrugated sheet to a noncorrugated sheet by fusion, cutting the joined sheets in a rectangular or parallelogram shape so as to provide several element units and layering the element units.

The demand for a ventilation system with a heat exchanger in cold districts or indoor warm swimming pools has increased with the spread of such kind of heat exchanges. Such environments have a problem in that a great temperature difference between supplied air and exhaust air is apt to form vapor condensation and that the above-mentioned converted paper can not withstand long use because of deformation due to the vapor condensation.

In order to solve this problem, there have been proposed a total heat exchanger wherein the partitions 20 are made of a moisture permeability and gas impermeability of element which is prepared from a polymer porous material having a good moisture resistance and coated with a water-soluble polymer including an absorbent, and the spacers 21 are made of polyethylene or polypropylene so as to have a corrugated shape (JP-B-425476), and a total heat exchanger wherein the partitions 20 are made of a porous material having a density with an air permeability of 20 sec/100 cc or more and coated with a water-insoluble and hydrophilic polymer (JP-B-48115).

These partitions 20 and spacers 21 have an advantage in that productibility is raised because the partitions and the spacers have a good bonding property with respect to each other, and that many structure units can be obtained by cutting a layered block. On the other hand, the spacers 21 have created a problem in that when air to be exhausted is at a high gas contamination level, the high gas permeability of the spacers allows the exhaust air to mix with supply air from end surfaces of the spacers as shown in FIG. 9, thereby contaminating the supply air by the exhaust air.

This problem has been solved by a heat exchanger wherein spacers are constituted by a gas impermeability film which is made of a porous material with a thin film having a gas impermeability in a structurally close contact therewith by overlapping, bonding or laminating, the spacers maintain spacing between adjoining partitions and two kinds of working airflows pass separated by the partitions (JP-A-7190666).

Total heat exchangers which have spacers provided with the gas impermeability film have solved the problem in that when air to be exhausted is at a high gas contamination level, exhaust air mixes with supply air to contaminate the supply air because the spacers 21 have a low gas permeability. Also, such total heat exchanger have offered the advantage in that productibility is raised because the partitions 20 and the spacers 21 have a good bonding property with respect to each other, and because many structure units can be obtained by cutting a layered block.

However, there has been created a problem in that material cost is increased and a time required for preparation is lengthened to raise cost because the spacers are constituted by a gas impermeability film which is made of a porous material with a thin film having a gas impermeability in a structurally close contact therewith by overlapping, bonding or laminating.

There has been created another problem in that it is difficult to form corrugation for maintaining spacing when heating and jointing by fusion are carried out in preparation of heat exchangers such as shaping or bonding because the porous material as a main material for the spacers has a softening temperature near to the softening temperature of the thin film.

SUMMARY OF THE INVENTION

It is an object of the present invention to solve these problems, and provide to a spacer for heat exchangers, an element for heat exchangers and a heat exchanger capable of offering a low gas permeability, a good formability in shaping and a good bonding property with respect to another element.

A spacer for heat exchangers according to the present invention includes a plate for forming and maintaining a first passage and a second passage which carry out heat exchange therebetween, and the plate is made of a material which is obtainable by mixing a fibrous material having a softening point and a resin material having a lower softening point than the fibrous material, followed by sheeting the mixture. As a result, the fibrous material can maintain a required shape of the spacer during thermal process for preparation, offering an advantage in that the spacer is unlikely to lose the shape.

The fibrous material may be made of cellulose fibers, and the resin material may be made of polyester or polyolefin such as PET (polyethylene terephthalate), PP (polypropylene) and PE (polyethylene). In this case, the fibrous material can maintain a required shape of the spacer at the conventional thermal process temperature for preparation, and the resin material can work for joint by fusion to offer an advantage in that the spacer become difficult to be lose the shape without need for significant modification to a manufacturing apparatus.

The plate may have at least one side formed with a resin coating. The spacer is unlikely to collapse, offering an advantage in that a form maintaining force is improved.

The fibrous material may be made of glass fibers, and the resin material may be made of polyester or polyolefin such as PET, PP and PE. The spacer is unlikely to collapse, offering advantages in that a form maintaining force is improved, and that thermal process is facilitated because the glass fibers have a fire resisting property.

The fibrous material may be made of metallic fibers, and the resin material may be made of polyester or polyolefin such as PET, PP and PE. In this case, shaping is facilitated and the spacer is unlikely to collapse, offering advantages in that a form maintaining force is improved and that thermal process is facilitated because the metallic fibers have a fire resisting property.

An element for heat exchangers according to the present invention comprises a spacer for forming and maintaining a first passage and a second passage which carry out heat exchange therebetween, and made of a material which is obtainable by mixing a fibrous material having a softening point and a resin material having a lower softening point than the fibrous material, followed by sheeting the mixture; and a partition for separating the first passage and the second passage and carrying out heat exchange therebetween, the partition being jointed to the spacer by fusion. As a result, the partition and the spacer can be jointed together by fusion without use of an adhesive, offering advantages in that manufacturing performance and productibility are improved and that the form maintaining capability of the spacer can be maintained at a high level during jointing.

The fibrous material may be made of cellulose fibers, and the resin material may be made of polyester or polyolefin such as PET, PP and PE. There have been offered advantages in that the partition and the spacer can be jointed together by fusion at the conventional thermal process temperature for bonding without need for significant modification to a manufacturing apparatus, that use of the cellulose fibers can prevent the spacer from losing the shape, and that use of the polyester or polyolefin resin can provide the element for heat exchangers with less expansion and contraction due to water.

The spacer may be have at least one side formed with a resin coating. In this case, the spacer is unlikely to collapse, and the spacer can become difficult to lose the shape even if a pressure is applied for jointing the partition and the spacer, offering an advantage in that handling of the element for heat exchangers is easy.

The fibrous material may be made of glass fibers, and the resin material may be made of polyester or polyolefin such as PETR PP and PE. In this case, the spacer is unlikely to collapse, and the spacer can become difficult to lose the shape even if a pressure is applied for jointing the partition and the spacer, offering advantages in that handling of the element is easy and that use of the glass fibers having a fire resisting property makes the thermal process easy.

The fibrous material may be made of metallic fibers, and the resin material may be made of polyester or polyolefin such as PET, PP and PE. In this case, the spacer is unlikely to collapse, and the spacer can become difficult to lose the shape even if a pressure is applied for jointing the partition and the spacer, offering advantages in that handling of the element is easy and that use of the metallic fibers having a fire resisting property makes the thermal process easy.

The partition may be constituted by overlapping a moisture permeability film having a gas impermeability, and an unwoven fabric. In this case, the partitions and the spacers can be jointed together without use of an adhesive requiring water as a solvent as usual, offering advantages in that there is no danger of moisture flowing a chemical agent and that there is no need for a drying process. There is no possibility that a change in temperature caused by heating for fusion-joint or cooling thereafter makes the moisture evaporate or adhere to flow a chemical agent. As a result, manufacturing performance and productibility are improved. The presence of the fibrous material can maintain the form maintaining capable of the spacers at a high level.

A heat exchanger according to the present invention comprises spacers for forming and maintaining a first passage and a second passage which carry out heat exchange therebetween, made of a material which is obtainable by mixing a fibrous material having a softening point and a resin material having a lower softening point than the fibrous material, followed by sheeting the mixture; partitions for separating the first passage and the second passage and carrying out heat exchange therebetween; and the spacers and the partitions being layered. The working airflows in the first passage and the second passage can be prevented from passing through the spacers or the partitions, and the two kinds of working airflows are prevented from mixing in the same passage. Since bonding the spacers and the partitions at contacted portions thereof provides no gap at the contacted portions which would contribute to gas leakage, the first airflow and the second airflow can be prevented from mixing.

The fibrous material may be made of cellulose fibers, and the resin material may be made of polyester or polyolefin such as PET, PP and PE. The resin material such as PET, PP and PE can enter between the pulp fibers in the spacer, and the mesh formed by pulp fibers is clogged with the resin material to raise the gas impermeability of the spacer, offering an advantage in that the heat exchanger has less gas migration to another passage.

The spacers have at least one side formed with a resin coating. The provision of the resin coating on the spacer can improve the gas impermeability to further reduce the gas migration to another passage in the heat exchanger, offering an advantage in that heat exchange performance is improved.

The fibrous material may be made of glass fibers, and the resin material may be made of polyester or polyolefin such as PET, PP and PE. Use of the glass fibers having a fire resisting property can offer an advantage in that the heat exchanger has a fire resisting property.

The fibrous material may be made of metallic fibers, and the resin material may be made of polyester or polyolefin such as PET, PP and PE. Use of the metallic fibers having a fire resisting property can offer advantages in that the heat exchanger has a fire resisting property and that the spacers have a high thermal conductivity to provide a fin effect so as to improve heat exchange performance.

The partitions may be constructed by overlapping a moisture permeability film having a gas impermeability, and an unwoven fabric. The working airflows can be prevented from passing through the spacers or the partitions, and the two kinds of working airflows are prevented from mixing in the same passage. Since bonding the spacer and the partition at contacted portions thereof provides no gap at the contacted portions which would contribute to gas leakage, the first airflow and the second airflow can be prevented from mixing. The partitions are unlikely to be affected by water in terms of expansion and contraction to provide the heat exchange with a water resistance. The partitions prevent air from passing therethrough but permits vapor to pass therethrough, offering an advantage in that the heat exchanger can withstand vapor condensation under circumstances having a great temperature difference or a great humidity difference.

The spacers may be dealt with water repellent finish. The spacers repel water, and the vapor condensation in the passages in the heat exchanger can be exhausted outside the heat exchanger by wind pressure without staying on the spot in the passages, offering an advantage in that an increase in pressure loss in the heat exchanger due to the vapor condensation is prevented.

The present invention provides a method for preparing a spacer for forming and maintaining a first passage and a second passage which carry out heat exchange therebetween, wherein a fibrous material having a softening point is mixed with a resin material having a lower softening point than the fibrous material, a sheeted material is prepared from the mixture by a paper machine, the sheeted material is shaped at a temperature which is lower than the softening point of the fibrous material and higher than the softening point of the resin material. The resin material is melted and spread in a plane form to increase the strength of the spacer as a whole and to provide the fiber material with form maintenance, offering an advantage in that the spacer is unlikely to lose the shape.

The present invention provides a method for preparing an element for heat exchanges, comprising a partition for separating a first passage and a second passage which carry out heat exchange therebetween, and a spacer for forming and maintaining the respective passages, wherein a fibrous material having a softening point is mixed with a resin material having a lower softening point than the fibrous material, a sheeted material is prepared from the mixture by a paper machine, the spacer is formed by shaping the sheeted material at a temperature which is lower than the softening point of the fibrous material and higher than the softening point of the resin material, and the spacer is jointed to the partition by fusion. The partition and the spacer can be jointed together without use of an adhesive as usual, offering an advantage in that productibility is improved.

The present invention provides a method for preparing a heat exchanger which comprises partitions for separating a first passage and a second passage which carry out heat exchange therebetween, and spacers for forming and maintaining the respective passages, wherein a fibrous material having a softening point is mixed with a resin material having a lower softening point than the fibrous material, a sheeted material is prepared from the mixture by a paper machine, the spacers are formed by shaping the sheeted material at a temperature which is lower than the softening point of the fibrous material and higher than the softening point of the resin material, and the partitions and the spacers are layered and jointed together by fusion. The partitions and spacers can be jointed together without use of an adhesive as usual, offering an advantage in that productibility is improved. Even if the resin material having a lower softening point is heated and melted for jointing, the fibrous material allows the spacers to maintain the shape even at a temperature at which the joint by fusion can be carried out, thereby offering an advantage in that the heat exchanger can not lose the shape.

BRIEF DESCRIPTION OF THE DRAWINGS

A more complete appreciation of the invention and many of the attendant advantages thereof will be readily obtained as the same becomes better understood by reference to the following detailed description when considered in connection with the accompanying drawings, wherein.

DESCRIPTION OF THE PREFERRED EMBODIMENTS

Now, the present invention will be described in detail in reference to the accompanying drawings.

Embodiment 1

Figure 1:
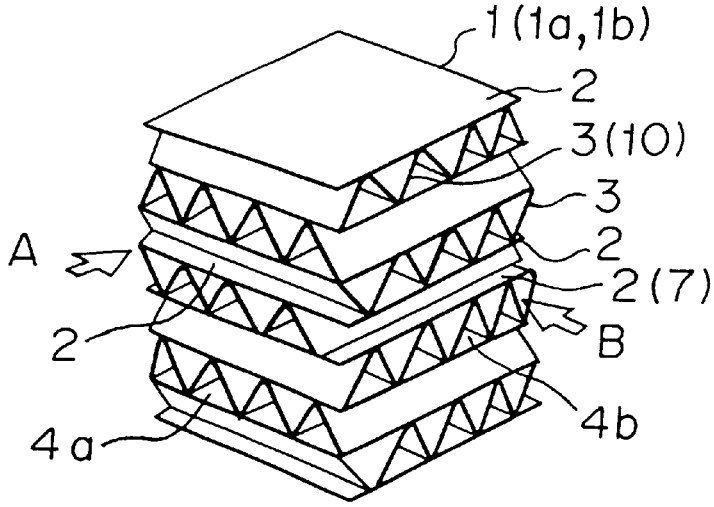
FIG. 1 is a perspective view showing a heat exchanger according to first through eleventh embodiments of the present invention.

In FIG. 1, there is shown a perspective view of a crossflow heat exchanger which is in a basic example according to embodiments of the present invention. In the specification, the word, heat exchanger, covers a sensible heat exchanger 1*a* and a total heat exchange 1*b*. Explanation of the embodiments will be made with respect to the sensible heat exchange 1*a*. In FIG. 1, reference numeral 1 designates the heat exchanger which carries out heat exchange between a first flow A and a second flow B which pass through the heat exchanger so as to flow directions perpendicular to each other in the horizontal direction in this figure. Reference numeral 2 designates partitions which are formed in a square shape in terms of a projected plane, which separate the first flow A and the second flow B, and which are made of a material which can carry out heat exchange between both flows A and B therethrough.

Reference numeral 3 designates spacers which have a wavy shape in section, which are interposed between adjacent partitions 2 to form and maintain predetermined spacing between the adjacent partitions so as to provide passages 4 for passing both flows, which are formed in a square shape in terms of a projected plane, and which are shaped in a corrugated plate. The partitions 2 and the spacers 3 are alternately layered so as to direct the ridges of adjacent spacers 3 perpendicularly with respect to each other, providing the heat exchanger 1 in a hexahedral shape. Reference numeral 4*a* designates first passages which are formed between adjacent partitions 2 by the respective spacers 3 to pass first flow A therethrough. Reference numeral 4*b* designates second passages which are formed in the same way as the first passages to pass the second flow B therethrough. The first passages and the second passages are alternately arranged so as to be directed perpendicularly with respect to each other through an adjacent partition 2. Reference numeral 7 designates a gas impermeability film which is formed on each of the partitions 2.

Figure 2:
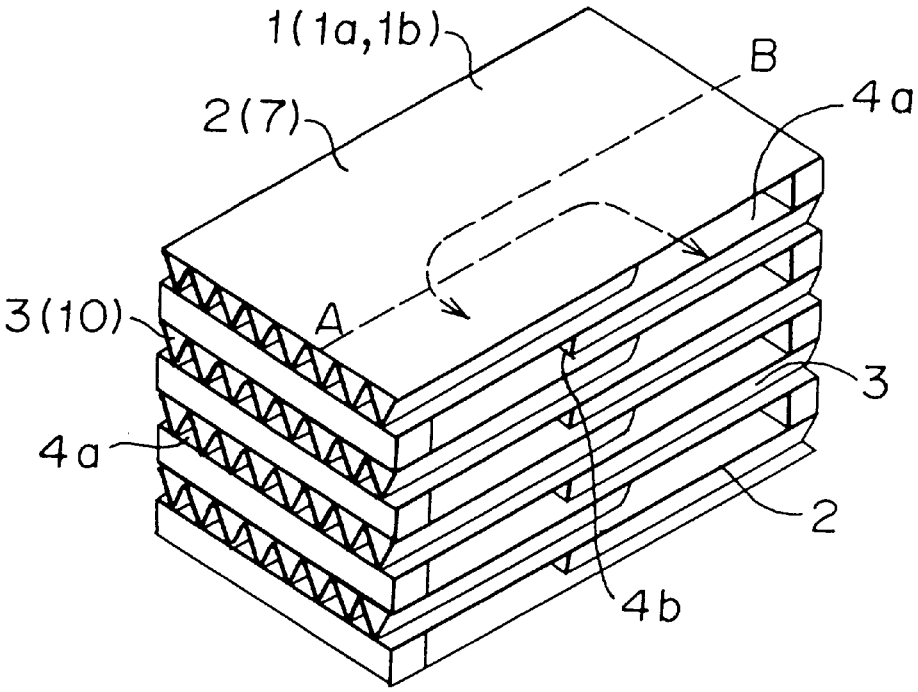
FIG. 2 is a perspective view showing a heat exchanger according to the first through eleventh embodiments of the present invention.

In FIG. 2, there is shown a perspective view of an opposed-flow heat exchanger which is another basic example according to the embodiments of the present invention. Explanation of the example shown in FIG. 2 will be explained with respect to the sensible heat exchanger 1*a* as the explanation of the example shown in FIG. 1. In FIG. 2, reference numeral 1 designates the heat exchanger which is constructed so that the first airflow A enters from one of opposed ends, the second flow B enters from the other end and both flows A and B flow out of the same side different from the opposed ends, and which carry out heat exchange between both airflows. Reference numeral 2 designates partitions which are formed in a rectangular shape in terms of a projected plane, which separate the first airflow A and the second airflow B, and which are made of a material which can carry out heat exchange between both flows A and B therethrough.

Reference numeral 3 designates spacers which have a wavy shape in section, which are interposed between adjacent partitions 2, which are located so as to be respectively offset toward the respective entering ends of the first flow A and the second flow b, and which form and maintain predetermined spacing between the adjacent partitions to provide passages 4 for passing the respective flows. The spacers are formed in a rectangular shape so as to have a slightly long length than half of a longer side of the partitions 2 in terms of a projected plane. The spacers are formed in a corrugated plate so that the ridges are directed perpendicularly to the side through which both flows A and B flow out. The partitions 2 and the spacers 3 are alternately layered so as to direct the ridges of the spacers 3 in parallel, providing the heat exchanger in a hexahedral shape.

Reference numeral 4*a* designates first passages which are formed between adjacent partitions 2 by the respective spacers 3 to pass the first flow A. Reference numeral 4*b* designates second passages which are formed in the same way as the first passages to pass the second flow B. The first passages and the second passages are alternately arranged so as to be directed in parallel with respect to each other through an adjacent partition 2. Reference numeral 10 designates a gas impermeability film which is formed on each of the spacers 3.

Figure 3:
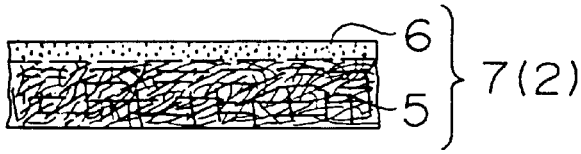
FIG. 3 is a cross-sectional view showing a partition of the heat exchanger according to the first, third and fifth embodiments of the present invention.

In FIG. 3, there is shown a cross-sectional view of each of the partitions 2 of the sensible heat exchanger 1*a* shown in FIGS. 1 and 2. In FIG. 3, reference numeral 7 designates the gas impermeability film which forms the respective partitions 2, which are constituted by overlapping a porous material 5 and a thin film 6 having a gas impermeability. In the specification, the word "overlapping" means to provide a layered structure in a closed contacted state by overlapping, jointing or laminating elements.

As the porous material 5 for the gas impermeability film 7, woven fabric, unwoven fabric or knitted cloth made of nylon or polyester fibers and having a thickness of 30 $\mu$m–100 $\mu$m can be used. As the thin film 6, a film material made of e.g. polyester, polyethylene or polypropylene and having a thickness 10 $\mu$m–50 $\mu$m can be used. The respective partitions 2 are constituted by the gas impermeability film 7 which is prepared by bonding or fusion-jointing the porous material 5 on one side or both sides of the thin film 6 in an overlapping way.

Figure 4:
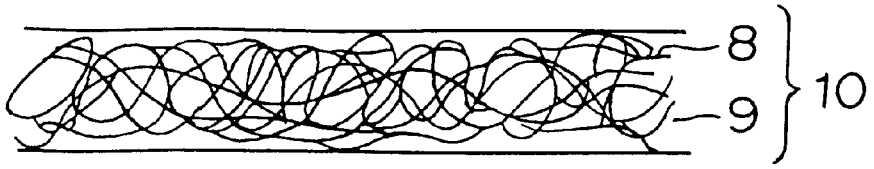
FIG. 4 is a cross-sectional view showing a spacer of the heat exchanger according to the first through eleventh embodiments of the present invention.

In FIG. 4, there is shown a cross-sectional view of each of the spacers 3 of the sensible heat exchanger 1*a* shown in FIGS. 1 and 2. In FIG. 4, reference numeral 10 designates a gas impermeability film which forms the respective spacers 3, and which is made of a material obtainable by mixing cellulose fibers 8 with a resin material 9, followed by sheeting the mixture. The resin material can be made of polyester or polyolefin such as polyethylene, polypropylene and polyethylene terephthalate, which has a relatively high reactivity. Since the paper thus prepared has a density with an air permeability of 100 sec/100 cc or more, the heat exchanger can reduce a gas migration ratio to 0.5% or less.

Now, a method for preparing the heat exchanger thus constructed will be explained. A manufacturing apparatus for the preparation is basically similar to a manufacturing apparatus for the conventional heat exchangers wherein spacers are made of paper. In a process for preparing paper for the spacers 3, the resin material 9 made of e.g. polyethylene, polypropylene or polyethylene terephthalate, and the cellulose fibers 8 are mixed in addition to the conventional paper material, and the mixture is sheeted by a paper machine as usual to prepare the gas impermeability film 10.

The gas impermeability film 10 thus sheeted is formed in a corrugated shape as usual to provide each of the spacers 3. The corrugated shape is provided by a corrugating machine. Since the cellulose fibers 8 in the gas impermeability film 10 can maintain the formed corrugated shape, the spacers are unlikely to lose shape in comparison with the conventional spacers. The gas impermeability film is ironed during being formed in the corrugated shape as usual. Since the ironing temperature is set to be lower than the softening temperature of the cellulose fibers 8 and higher than the softening temperature of the resin material 9, the resin material 9 is melted and spread widely in a plane form to increase the strength of the gas impermeability film as a whole, preventing the corrugated portion from being likely to collapse. As a result, the spacers 3 are unlikely to lose the shape and have a large form maintaining force for the corrugated shape.

After each of the spacers 3 is formed to have the corrugated shape, each of spacers is jointed to one side of each of the partitions 2 in a flat plate by fusion to prepare an element for heat exchangers so that an element unit is formed to have one side provided with the corrugated portion. At that time, the temperature for jointing by fusion is set to be lower than the softening temperature of the cellulose fibers 8 and higher than the softening temperature of the resin material 9. Although the resin material 9 in the each of the spacers 3 is melted to jointed to each of the partitions 2 by fusion, the cellulose fibers 8 is prevented from being melted, and maintains the corrugated shape of each of the spacers 3. This means that each of the spacers 3 does not lose the corrugated shape and that each of the spacers is jointed to each of the partitions 2 to prepare the element for heat exchangers without use of an adhesive as usual.

A plurality of such elements for heat exchangers thus prepared are layered so as to contact each of the partitions 2 and each of the spacers 3, and the layered elements are bonded by a vinyl acetate resin emulsion type adhesive to provide the sensible heat exchanger 1*a* having the structure shown in FIGS. 1 and 2. If, after having layered such elements for heat exchangers, the elements are bonded by blowing in the passages 4 warm air having a temperature which is lower than the softening temperature of the cellulose fibers 8 and higher than the softening temperature of the resin material 9, the resin material 9 is melted to joint the partitions 2 and the spacers 3 by fusion without use of such a vinyl acetate resin emulsion type adhesive, dispensing with a drying process for the adhesive.

As another method for preparing the heat exchangers with respect to the crossflow heat exchanger shown in FIG. 1, the partitions 2, and the spacers 3 formed in a corrugated shape by the same method as the one as just mentioned are alternately layered so as to have the ridges of the spacers 3 directed perpendicularly to the ridges of their adjacent spacers. If warm air having a temperature which is lower than the softening temperature of the cellulose fibers 8 and higher than the softening temperature of the resin material 9 is blown in the passages 4, the resin material 9 is melted to joint the partitions 2 and the spacers 3 by fusion.

With respect to the opposed-flow heat exchanger 3 shown in FIG. 2, the partitions 2, and the spacers 3 formed in a corrugated shape by the same method as the one just above mentioned are layered so that each of the spacers 3 have the ridges directed in parallel with the ridges of the other spacers, and so that the spacers are alternately offset to an end and to the other end in a direction where the long side of the partitions 2 is located. Warm air having a temperature which is lower than the softening temperature of the cellulose fibers 8 and higher than the softening temperature of the resin material 9 is blown in the passages 4, the resin material 9 is melted to joint the partitions 2 and the spacers 3 by fusion.

Although bonding a layered structure generally requires pressing, the first method and the second method are different in terms of benefit as follows. When a plurality of elements for heat exchangers are prepared, layered and then jointed together by fusion, the respective elements for heat exchangers are layered in such a state that the top of the ridges on one side of the respective spacers 3 has been already bonded to the respective partitions 2. As a result, when compaction is applied in the layered direction during fusion-jointing in preparation for heat exchangers, the corrugations of the respective spacers 3 are prevented from spreading or collapsing, allowing the passages 4 to be formed with required spacing and shape in a good way. On the other hand, when the partitions 2 and the spacers 3 are alternately layered and then jointed together by fusion, a process for preparing respective elements for heat exchangers can be eliminated to facilitate assembly.

According to the sensible heat exchanger 1*a* thus constructed, the partitions 2 have a gas impermeability given by the thin film 6, and the spacers 3 which extend upward and downward in the passages 4 prevent the working flows A and B from passing therethrough. The working flows A and B are also prevented from passing through the partitions 2. There is no possibility that the two kinds of the working flows A and B are mixed between the passages 4. The gas impermeability film 7 which is prepared by overlapping the porous material 5 and the thin film 6 having a gas impermeability can be easily cut in the layered state, increasing the productibility of the element for heat exchangers.

Since the porous material 5 itself is good in adhesive property, the spacers 3 and the partitions 2 can have contacted portions bonded, thereby avoiding creation of gaps which cause gas leakage at the contacted portions. When the sensible heat exchanger is applied to e.g. an air-conditioning and ventilation system, fresh outdoor supply air can be subjected to heat exchange without being contaminated even if air to be ventilated is at a high gas contamination level.

Embodiment 2

Now, an embodiment of the present invention will be explained with respect to a case wherein the heat exchanger is formed as a total heat exchanger. The shape of the heat exchanger and the spacers 3 are similar to those of the heat exchangers 1 shown in FIGS. 1 and 2. Identical or corresponding constituent elements are indicated by the same reference numerals as those of the first embodiment described referring to FIGS. 1 and 2, and explanation of those constituent elements will be omitted. In this embodiment, the material of partitions 2 are different from that of the sensible heat exchanger 1*a* according to the first embodiment through the shape of the heat exchanger 1 is similar to the ones shown in FIGS. 1 and 2.

Figure 5:
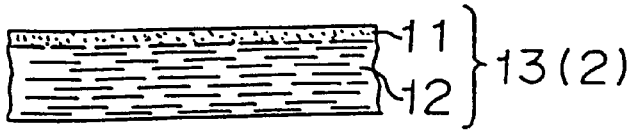
FIG. 5 is a cross-sectional view showing a partition of the heat exchanger according to the second through fifth embodiments of the present invention.

In FIG. 5, there is shown a cross-sectional view of each of the partitions 2 of the total heat exchanger 1*b* shown in FIGS. 1 and 2. In FIG. 5, reference numeral 13 designates a moisture permeability film which forms the respective partitions 2, and which is constituted by overlapping a porous material 11 and a thin film 12 having a moisture permeability which selectively permits vapor to pass. As the porous material 11 for the moisture permeability film 13, a porous nonfibrous sheet which is made of e.g. polyethylene, polypropylene, cellulose acetate or polytetrafluoroethylene and which is commercially available can be used.

As the thin film 12 having a moisture permeability, a polyurethane resin containing an oxyethylene group, a polyester resin containing an oxyethylene group, or a resin material containing a sulfonic acid group, an amino group or carboxyl group at the terminal or side chain, which are water-insoluble hydrophilic polymers, can be used. Each of the partitions 2 is constituted by the moisture permeability film 13 which is prepared by coating the resin material on one side of the porous material 11 to form the thin film 12 made of a water-insoluble hydrophilic polymer on the porous material.

Figure 6:
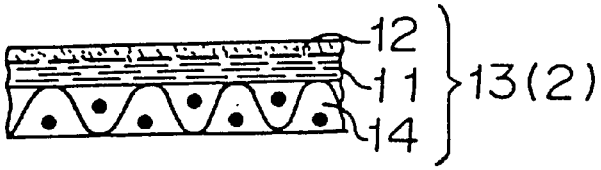
FIG. 6 is a cross-sectional view showing a partition of the heat exchanger according to the second through fifth embodiments of the present invention.
Figure 7:
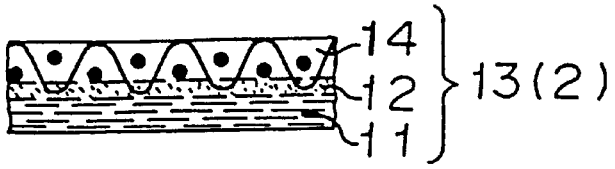
FIG. 7 is a cross-sectional view showing a partition of the heat exchanger according to the second through fifth embodiments of the present invention.
Figure 8:
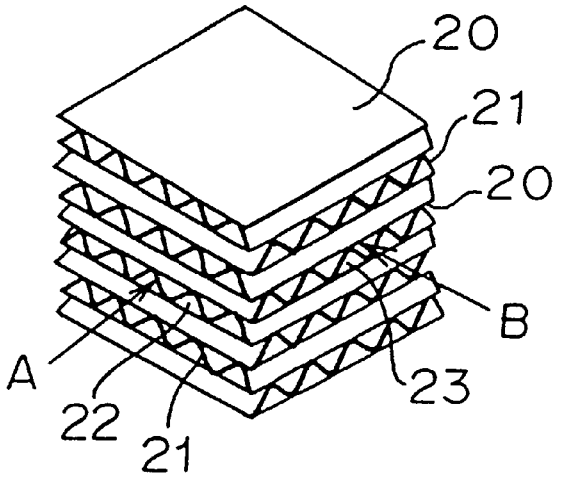
FIGURE 8 PRIOR ART
FIG. 8 is a perspective view showing a conventional heat exchanger.
Figure 9:
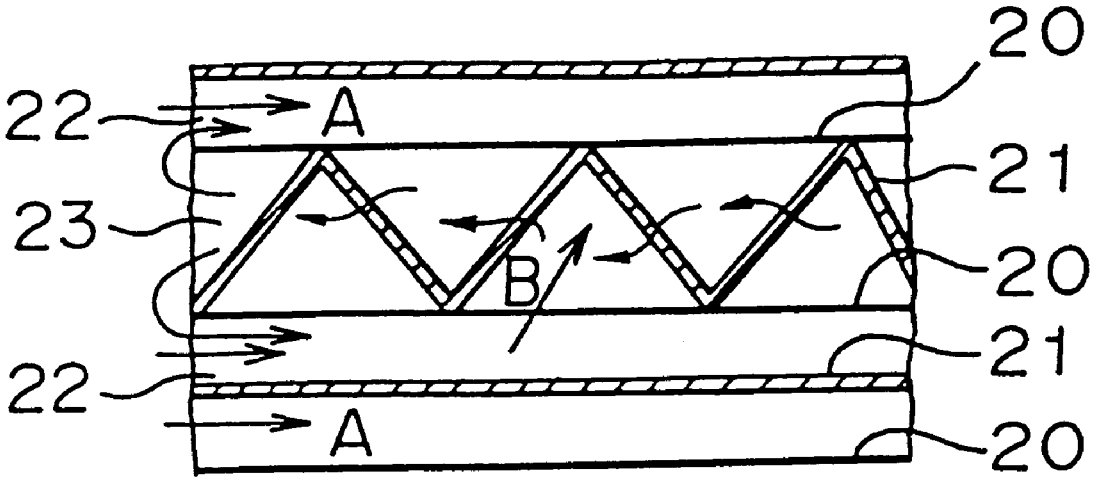
FIGURE 9 PRIOR ART
FIG. 9 is a cross-sectional view showing the conventional heat exchanger.

The respective partitions 2 of the total heat exchanger 1*b* may be constituted by another moisture permeability film 13 which is prepared by overlapping the film 13 just stated and base cloth 14 having a gas permeability as shown in cross-sectional view of FIGS. 6 and 7. The base cloth 14 can be prepared from woven fabric, unwoven fabric or knitted cloth which is made of e.g. nylon or polyester. The base cloth is overlapped on one side of the porous material 11 or a surface of the thin film 12 by bonding to provide the moisture permeability film 13 with a three-layered structure.

The respective spacers 13 of the total heat exchanger 1*b* according to this embodiment is the same as those according to the first embodiment shown in the cross-sectional view of FIG. 4. In FIG. 4, reference numeral 10 designates the gas impermeability film which forms the respective spacers 3, and which is made of a material prepared by mixing the cellulose fibers 8 with the resin material 9 and sheeting the mixture. The resin material 9 can be made of polyester or polyolefin having a relatively high reactivity, such as polyethylene, polypropylene or polyethylene terephthalate. The paper thus prepared can have a density with an air permeability of 100 sec/100 cc or more to provide the heat exchanger with a gas migration ratio of 0.5% or less.

The heat exchanger thus constituted can be manufactured by a manufacturing apparatus and a manufacturing method similar to those of the first embodiment. According to the total heat exchanger 1*b* having a such a structure, the partitions 2 have a gas impermeability and a moisture permeability given by the thin film 12 having a moisture permeability. The spacers 3 which extend upwardly and downwardly in the passages 4 can prevent the working flows A and B from passing therethrough, and the partitions 2 can prevent the working flows A and B from passing through. As a result, there is no possibility that the two kinds of working flows A and B are mixed between the passages 4.

The moisture permeability film 13 which is prepared by overlapping the thin film 12 on the porous material 11 can be easily cut in such a layered state, and the porous material itself has a good adhesive property. The spacers 3 and the partitions 2 can have contacted portions bonded, thereby avoiding creation of gaps which contribute to gas leakage at the contacted portions. When the heat exchanger thus constructed is applied to e.g. an air-conditioning and ventilation system, fresh outdoor supply air can be subjected to heat exchange without being contaminated even if air to be ventilated is at a high gas contamination level.

In the first and the second embodiment, the fibrous material 8 as one of the materials for the spacers 3 is made of cellulose, reducing cost. The resin material 9 as one of the materials for the spacers 3 is made of PET, PP, PE or their equivalent. The spacers can exhibit a property to carry out fusion-joint at a temperature between 100° C. and 200° C., at which pressing has been made for preparation of a conventional single faced corrugated board. The spacers and the partitions can be jointed by fusion to provide the element for heat exchangers without modifying the conventional manufacturing apparatus. Since the jointing can be made by fusion, there is no need for a water-soluble adhesive, dispensing with a drying process to improve manufacturing performance.

The PET, PP and PE are a material free from expansion and contraction caused by water. Since the resin material 9 can constrain the expansion and contraction of the pulp fibers which is caused by water in the gas impermeability film 10 after sheeting, the spacers have a water-resisting property. By dealing with a hot press before forming the element for heat exchangers or blowing warm air in the element for heat exchangers after forming the element, PET, PP, PE or their equivalent enters between pulp fibers in the spacers, and the mesh formed by the pulp fibers is clogged with the resin material to raise the air permeability.

When the spacers are applied to a heat exchanger, PET, PP, PE or their equivalent can enter between the pulp fibers in the gas impermeability film 10, and the mesh formed by the pulp fibers can be clogged with the resin material to provide the heat exchanger with less gas migration to another passage. Since the spacers 3 are strong in water, a sensible heat exchanger and a total heat exchanger which are strong in water can be provided if the partitions 2 are made of a plastic material or a moisture permeability film having a gas impermeability.

If the conventional resinous elements for heat exchangers are used to form a sensible heat exchanger, a method wherein heat exchangers having a required size are cut out from a larger size of heat exchanger prepared by layering can not be adopted. This is because the conventional resinous elements are weak in heat and because the cut heat exchangers have end surfaces deformed. In order to cope with this problem, there has been proposed a method wherein each of the partitions and each of the spacers are cut in a required size before layering. According to this embodiment, the method wherein a plurality of heat exchangers having a desired size are cut out from a larger size of heat exchanger prepared by using larger size of elements for heat exchangers, and which is similar to a method for preparation of heat exchangers using paper can be adopted to remarkably improve productibility in comparison with the conventional sensible heat exchanger. This is because the spacers 3 are prepared by mixing the cellulose fibers 8 with the resin material 9 made of e.g. PET, PP and PE and sheeting the mixture, and the spacers are relatively strong in heat.

Embodiment 3

Figure 4A:
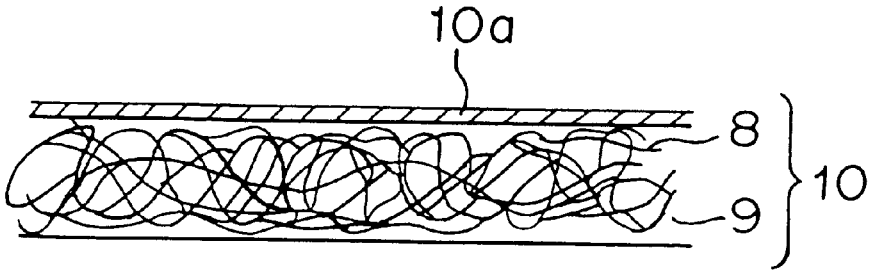
FIG. 4A is a cross-sectional view showing a spacer of the heat exchanger according to the third embodiment of the present invention.
Figure 4B:
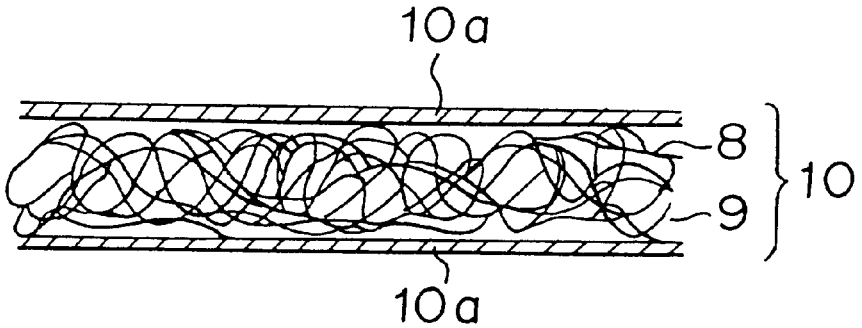
FIG. 4B is a cross-sectional view showing another spacer of the heat exchanger according to the third embodiment of the present invention.

Now, another embodiment of the present invention will be explained. Since this embodiment is similar to the first and the second embodiment shown in FIGS. 1–7 in terms of basic structure. Identical or corresponding parts are indicated by the same reference numerals as those of the first and the second embodiment, and explanation of these parts will be omitted. This embodiment is characterized in that the spacers 3 have both sides or one side formed with a resin coating. Specifically, the gas impermeability film 10 shown in FIG. 4 has an upper surface or a lower surface formed with the resin coating 10*a* as shown in FIGS. 4A and 4B. The other features of this embodiment are the same as those of the first and the second embodiment.

According to this embodiment, the resin coating allows the gas impermeability film 10 to be unlikely to lose the shape in addition to the presence of the effects obtained by the first and the second embodiment. Shaping for preparation of the corrugation is facilitated, and deformation by an external force after formation of the corrugation is difficult to occur. The degree to which the corrugation of the spacers 3 is deformed or collapsed when the partitions 2 and the spacers 3 are jointed together by fusion and by pressing in preparation of an element for heat exchangers can be minimized, and the element can be prepared by the jointing so as to have a desired shape.

When the method wherein heat exchangers having a required size are obtained by cutting larger size of elements for heat exchangers layered is adopted for preparation of heat exchangers, the resistance of the spacers 3 to collapse allows the respective heat exchanges having a required size to be unlikely to be collapsed at cut ends by a cutting force, improving handling and manufacturing performance in addition to the pressure of the functions and the effects just above mentioned. In addition, the resin coating can raise the air permeability of the spacers, further reducing the gas migration in a heat exchanger, and improving heat exchange performance.

There is no limitation with respect to the material for the partitions, to which the spacers are jointed. The spacers can be combined with the conventional partitions in a wide range.

Embodiment 4

Now, another embodiment will be explained. This embodiment is similar to the first and the second embodiment shown in FIGS. 1–7 in terms of basic structure. Identical or corresponding parts are indicated by the same reference numerals as those of the first and the second embodiment, and explanation of these parts will be omitted. This embodiment is characterized in that the fibers 8 as one of the materials for the spacers 3 according to the first embodiment are replaced by glass fibers, and that the resin material 9 having a lower softening point than glass fibers is made of polyester or polyolefin such as PET, PP or PE as in the first embodiment. The other features of this embodiment are the same as those of the first and the second embodiment.

According to this embodiment, the glass fibers allow the gas impermeability film 10 to be unlikely to lose the shape, and deformation by an external force after formation of the corrugation is difficult to occur, in addition to the presence of the effects obtained by the first and the second embodiment. The degree to which the corrugation of the spacers 3 is deformed or collapsed when the partitions 2 and the spacers 3 are jointed together by fusion and by pressing for preparation of elements for heat exchanges can be minimized, and the elements for heat exchangers can be prepared by the jointing so as to have a desired shape. Since the glass fibers have a fire resisting property, the spacers are strong in heat, facilitating thermal process.

When the method wherein heat exchangers having a required size are obtained by cutting larger size of elements for heat exchangers layered is adopted for preparation of heat exchangers, the resistance of the spacers 3 to collapse allows the respective heat exchangers having a required size to be unlikely to be collapsed at cut end by a cutting force, improving handling and manufacturing performance, in addition to the presence of the functions and the effects just above mentioned. In addition, since the glass fibers have a fire resisting property, the heat exchangers thus prepared can have a fire resisting property.

There is no limitation with respect to the material for the partitions, to which the spacers are jointed. The spacers can be combined with the conventional partitions in a wide range.

Embodiment 5

Now, another embodiment will be explained. This embodiment is similar to the first and the second embodiment shown in FIGS. 1–7 in terms of basic structure. Identical or corresponding parts are indicated by the same reference numerals as those of the first and the second embodiment, and explanation of these parts will be omitted. This embodiment is characterized in that the fibers 8 as one of the materials for the spacers 3 according to the first embodiment are replaced by metallic fibers, and that the resin material 9 having a lower softening point than metallic fibers is made of polyester or polyolefin such as PET, PP or PE as in the first embodiment. The other features of this embodiment are the same as those of the first and the second embodiment.

According to this embodiment the metallic fibers allow the gas impermeability film 10 to be unlikely to lose the shape, and deformation by an external force after formation of the corrugation is difficult to occur, in addition to the presence of the effects obtained by the first and the second embodiment. The degree to which the corrugation of the spacers 3 is deformed or collapsed when the partitions 2 and the spacers 3 are jointed together by fusion and by pressing in preparation of elements for heat exchanges can be minimized, and the elements for heat exchangers can be prepared by the jointing so as to have a desired shape. In addition, since the metallic fibers have a fire resisting property, the spacers are strong in heat, facilitating thermal process.

When the method wherein heat exchangers having required size are obtained by cutting larger size of elements for heat exchangers layered is adopted for preparation of heat exchangers, the resistance of the spacers 3 to collapse allows the respective heat exchangers having a required size to be unlikely to be collapsed at cut end by a cutting force, improving handling and manufacturing performance, in addition to the presence of the functions and the effects just above mentioned. Since the metallic fibers have a fire resisting property, the heat exchangers thus prepared can have a fire resisting property. If the metallic fibers are made of metal having a high thermal conductivity such as aluminum, the fin effect can be provided to improve heat exchange performance.

There is no limitation with respect to the material for the partitions, to which the spacers are jointed. The spacers can be combined with the conventional partitions in a wide range.

Embodiment 6

Now, another embodiment will be explained. This embodiment is similar to the first and the second embodiment shown in FIGS. 1, 2 and 4 in terms of basic structure. Identical or corresponding parts are indicated by the same reference numerals as those of the first and the second embodiment, and explanation of these parts will be omitted. This embodiment is characterized in that the partitions 2 are made of a paper material unlike the first and the second embodiment. The other features of this embodiment are the same as those of the first through the fifth embodiment.

Even if the partitions 2 are made of a usually and widely used paper material according to this embodiment, the partitions 2 and the spacers 3 can be jointed together without use of an adhesive requiring water as a solvent in corrugation by a corrugating machine unlike the prior art, dispensing with a process for drying the paper material, in addition to the presence of effects offered by the materials forming the spacers 3 according to the first through the fifth embodiment. Manufacturing performance in assembly is improved. The element for heat exchangers can be automatically prepared.

When the partitions are used to prepare a heat exchanger, it is not necessary to wait for an adhesive to dry in layering the partitions 2 and the spacers because there is no need for an adhesive requiring water as a solvent as usual. There is no possibility that jointed portions of the partitions and the spacers are shifted during application of a pressing force to the layered partitions and spacers because of the pressure of some time to dry an adhesive. It is also unnecessary to blow in warm air for a long time to dry an adhesive after jointing through it may be necessary to blow in warm air for completion of jointing by fusion. Manufacturing performance can be improved to shorten a manufacturing time.

Embodiment 7

Now, another embodiment will be explained. This embodiment is similar to the first and the second embodiment shown in FIGS. 1, 2 and 4 in terms of basic structure. Identical or corresponding parts are indicated by the same reference numerals as those of the first and the second embodiment, and explanation of those parts will be omitted. This embodiment is characterized in that the partitions 2 are made of a plastic material unlike the first and the second embodiment. The other features of this embodiment are the same as the first through the fifth embodiment.

According to this embodiment, it is possible to obtain the effects offered by the materials of the spacers 3 according to the first through the fifth embodiment. When the partitions 2 are made of a plastic material widely used in the conventional sensible heat exchanger and so on, the partitions 2 are strong in water and do not permit air to pass therethrough because the partitions themselves are a resinous member. When corrugation by a corrugating machine is carried out with use of an adhesive requiring water as a solvent as usual, the adhesive spreads and remains on a surface of the partitions 2, creating a problem in that the adhesive spreads in a wider range if warm air is blown in to dry the adhesive.

According to this embodiment, it is possible to joint the partitions 2 and the spacers 3 without use of an adhesive for preparation of an element for heat exchanges. There is no need for a drying process, and the adhesive can be prevented from spreading. Manufacturing performance in assembly can be improved, and the elements for heat exchanger can be automatically prepared.

When the element for heat exchanger is used to prepare a heat exchanger, heat exchange performance can be improved because no adhesive spreads on a surface of the partitions 2 and because no adhesive disturbs heat exchange.

When the elements for exchangers is used to prepare a heat exchanger, it is not necessary to wait for an adhesive to dry in layering the partition 2 and the spacers because there is no need for an adhesive requiring water as a solvent as usual. There is no possibility that jointed portions are shifted during application of a pressing force to the layered partitions and the spacers because of the pressure of some time to dry an adhesive. It is also unnecessary to blow in warm air for a long time to dry an adhesive after jointing though it may be necessary to blow in warm air for completion of jointing by fusion. Manufacturing performance can be improved to shorten a manufacturing time.

This embodiment is suited to a sensible heat exchanger for these reasons.

Embodiment 8

Now, another embodiment will be explained. This embodiment is similar to the first and the second embodiment shown in FIGS. 1, 2 and 4 in terms of basic structure. Identical or corresponding parts are indicated by the same reference numerals as those of the first and the second embodiment, and explanation of those parts will be omitted. This embodiment is characterized in that the partitions 2 are prepared by laminating unwoven fabric and a moisture permeability film having a gas impermeability represented by a film commercially available under the trademark Gore-Tex unlike the first and the second embodiment. The other features of this embodiment are the same as those of the first through the fifth embodiment.

According to this embodiment, the partitions 2, which are a resinous member, are strong in water in addition to the presence of the effect offered by the materials for the spacers 3 according to the first through the fifth embodiment. In addition, the partitions are made of such a moisture permeability film having a so-called gas impermeability which prevents air from passing but permits vapor to pass, and no chemical is used. Since the partitions 2 and the spacers 3 can be jointed in corrugation by a corrugating machine for preparation of an element for heat exchangers without use of an adhesive requiring water as a solvent as usual, there is no danger of water flowing a chemical, and there is no need for a drying process. There is no possibility that a change in temperature due to heating by fusion-joint or cooling thereafter causes moisture to evaporate or adhere, thereby flowing a chemical.

When the partitions 2 are used to prepare a heat exchanger, the partitions are unlikely to be subjected to expansion and contraction due to water. The heat exchanger can have a resistance to water. Since the partitions are not dealt with a chemical, there is no possibility that a chemical is flowed by vapor condensation to degrade heat exchange performance. Because the partitions prevent air from passing therethrough but permits vapor to pass therethrough, a total heat exchanger prepared by using the partitions according to this embodiment can have a resistance to vapor condensation so as to be operable under circumstances having a wide temperature difference and a wide humidity difference.

When the partitions according to this embodiment are used to prepare a heat exchanger, it is not necessary to wait for an adhesive to dry in layering the partitions 2 and the spacers because there is no need for an adhesive requiring water as solvent as usual. There is no possibility that jointed portions are shifted during application of a pressing force to the layered partitions and the spacers because of the pressure of some time to dry an adhesive. It is also unnecessary to blow in warm air for a long time to dry an adhesive after jointing though it may be necessary to blow in warm air for completion of jointing by fusion. Manufacturing performance can be improved to shorten a manufacturing time.

Embodiment 9

Now, another embodiment will be explained. This embodiment is similar to the first and the second embodiment shown in FIGS. 1, 2 and 4 in terms of basic structure. Identical or corresponding parts are indicated by the same reference numerals as those of the first and the second embodiment, explanation of these parts will be omitted. This embodiment is characterized in that the partitions 2 are prepared by laminating paper and a moisture permeability film having a gas impermeability represented by a film commercially available under the trademark Gore-Tex in place of the materials according to the first and the second embodiment. The other features of this embodiment are the same as those of the first through the fifth embodiment.

According to this embodiment, the partitions 2 are strong in water in addition to the presence of the effects offered by the materials for the spacers 3 according to the first through the fifth embodiment. In addition, the partitions are made of such a moisture permeability film having a so-called gas impermeability which prevents air from passing therethrough but permits vapor to pass therethrough. No chemical is used. Since the partitions 2 and the spacers 3 can be jointed without use of an adhesive agent requiring water as a solvent as usual in corrugation by a corrugating machine for preparation of an element for heat exchangers, there is no danger of water flowing a chemical, and there is no need for a drying process. There is no possibility that a change in temperature due to heating by fusion-jointing or cooling thereafter causes moisture to evaporate or adhere, thereby flowing a chemical. When the partitions according to this embodiment are used to prepare a heat exchanger, the partitions 2 are unlikely to be subjected to expansion and contraction due to water. The heat exchanger can be strong in water. Since the partitions are not dealt with a chemical, there is no possibility that a chemical is flowed by vapor condensation to reduce heat exchange performance. Because the partitions prevent air from passing therethrough but permits vapor to pass therethrough, a total heat exchanger prepared by using the partitions according to this embodiment can have a resistance to vapor condensation so as to be operable under circumstances having a wide range of temperature difference and a wide range of humidity difference. Although the heat exchanger according to this embodiment is inferior to use of unwoven cloth according to the eighth embodiment in terms of a resistance to vapor condensation, cost can be reduced.

When the partitions according to this embodiment are used to prepare a heat exchanger, it is not necessary to wait for an adhesive to dry in layering the partitions 2 and the spacers because there is no need for an adhesive requiring water as a solvent as usual. There is no possibility that jointed portions are shifted during application of a pressing force to the layered partitions and spacers because of the presence of some time to dry an adhesive. It is also unnecessary to blow in warm air for a long time to dry an adhesive after jointing through it may be necessary to blow in warm air for completion of jointing by fusion. Manufacturing performance can be improved to shorten a manufacturing time.

Embodiment 10

Now, another embodiment will be explained. This embodiment is similar to the first through the ninth embodiment shown in FIGS. 1 through 7 in terms of basic structure. Identical or corresponding parts are indicated by the same reference numerals as those of the first through the ninth embodiment, and explanation of these parts will be omitted. This embodiment is characterized in that the spacers 3 are dealt with water repellent finish. The other features of this embodiment are the same as those of the first through the ninth embodiment.

According to this embodiment, the spacers can repel water because of repellent finish in addition to the presence of the effects offered by the first through the ninth embodiment. When the partitions are used to prepare a heat exchanger, vapor in the passages of the heat exchanger 1 is prevented from staying on the spot, and is eliminated out of the heat exchanger 1 by wind pressure, thereby making a raise in pressure loss due to vapor condensation difficult in the heat exchanger 1.

Embodiment 11

Now, another embodiment will be explained. This embodiment is similar to the first and the second embodiment shown in FIGS. 1, 2 and 4 in terms of basic structure. Identical or corresponding parts are indicated by the same reference numerals as those of the first and the second embodiment, explanation of these parts will be omitted. This embodiment is characterized in that the partitions 2 are made of the same material as the spacers 3 according to the first embodiment. The partitions 2 according to this embodiment can be shown by the cross-sectional view of FIG. 4.

In FIG. 4, the reference numeral 10 designates the gas impermeability film which forms each of the spacers 3, and which are prepared by mixing the cellulose fibers 8 with the resin material 9, followed by sheeting the mixture. The resin material 9 can be made of polyester or polyolefin having a relatively high reactivity such as polyethylene, polypropylene and polyethylene terephthalate. Since the paper thus prepared has a density with an air permeability of 100 sec/100 cc or more, the heat exchanger can have a gas migration ratio of 0.5% or less. The other features of this embodiment are the same as those of the first through the fifth embodiment.

A method for preparing the heat exchanger thus constructed will be explained. Explanation of the manufacturing apparatus and the manufacturing method for the spacers 2 will be omitted because the manufacturing apparatus and manufacturing method for the spacers are not different from those for the first embodiment. Now, a manufacturing apparatus and a manufacturing method for the partitions 2 will be explained. The manufacturing apparatus for the partitions 2 is basically similar to the manufacturing apparatus for the conventional heat exchangers using a paper material for the partitions. In a process for preparing a paper as a material for the partitions 2, a resin material 9 such as polyethylene, polypropylene and polyethylene terephthalate, and cellulose fibers 8 are mixed with the conventional paper material, and the mixture is sheeted by a paper machine as usual to create a gas impermeability film 10.

The gas impermeability film 10 thus sheeted is formed in a plate form as in the prior art to obtain each of the partitions 2. The partitions 2 thus prepared are unlikely to lose the shape by the presence of the cellulose fibers 8, and have a strong form maintaining force.

After having prepared a partition 2, a corrugated spacer 3 has the top of ridges on one side jointed to the partition by fusion to provide an element for heat exchangers as an element unit so that the element unit is formed to have one side provided with the corrugation. At that time, the temperature for jointing by fusion is lower than the softening temperature of the cellulose fibers 8 and higher than the softening temperature of the resin material 9. Although the partition 2 and the resin material 9 in the spacer 3 are jointed by fusion, the cellulose fibers 8 are not melted, and the flat shape of the partition 2 and the corrugated shape of the spacer 3 can be maintained. In other words, the partition 2 and the spacer 3 can be jointed together to prepare the element for heat exchangers without collapse in the flat shape of the partition and the corrugated shape of the spacer and without use of an adhesive as usual.

A plurality of elements for heat exchanges thus prepared are layered so as to contact the partition 2 of an element for heat exchangers with the spacer 3 of another element for heat exchangers, and the partition and the spacer are bonded by a vinyl acetate resin emulsion type adhesive to provide a sensible heat exchanger 1 having the structure shown in FIGS. 1 or 2. If after having layered the elements for heat exchangers, warm air which has a temperature lower than the softening temperature of the cellulose fibers 8 and higher than the softening temperature of the resin material 9 is blown in the passages 4 of the layered elements without use of a vinyl acetate resin emulsion type adhesive, the resin material 9 is melted to joint the partition 2 and the spacers 3 by fusion, dispensing with a drying process.

As another method for preparing a crossflow heat exchanger 1 shown in FIG. 1, the spacers 3 which are formed in a corrugated plate by the manufacturing method just above mentioned, and the spacers 3 are alternately arranged so as to have the ridges of the spacers 3 directed perpendicular to the ridges of their adjacent spacers, and warm air which has a temperature lower than the softening temperature of the cellulose fibers 8 and higher than the softening temperature of the resin material 9 is blown in the passages 4. As a result, the resin material 9 is melted to joint the partitions 2 and the spacers 3 by fusion. In the case of the opposed-flow heat exchanger 1 shown in FIG. 2, the partitions 2 and the spacers 3 are layered so as to have the ridges of the spacers 3 directed in parallel with the ridges of their adjacent spacers so that the spacers are alternately offset to an end and to the other end in a direction where the long side of the partitions is located, and warm air which has a temperature lower than the softening temperature of the cellulose fibers 8 and higher than the softening temperature of the resin material 9 is blown in the passages 4. As a result, the resin material 9 is melted to joint the partitions 2 and the spacers 3 by fusion. The difference between the first method for preparing the heat exchanger and the second method for preparing the heat exchanger is the same as the one described with reference to the first embodiment.

As explained, according to the heat exchanger 1 having such a structure, the working flows A and B are prevented from passing through the spacers 3 which extend upward and downward in the passages 4. The working flows A and B are prevented from passing through the partitions 2. As a result, the two kinds of the working flows A and B are prevented from mixing between the passages 4. The partitions 2 and the spacers 3 can have contacted portions jointed, thereby avoiding creation of gaps which contribute to gas leakage at the contacted portions. When the heat exchanger according to this embodiment is applied to e.g. an air-conditioning and ventilation system, fresh outdoor supply air can be subjected to heat exchange without being contaminated even if air to be ventilated is at a high gas contamination level.

The partitions 2 according to this embodiment can be combined with spacers 3 which are made of a conventional material.

Obviously, numerous modifications and variations of the present invention are possible in light of the above teachings. It is therefore to be understood that within the scope of the appended claims, the invention may be practiced otherwise than as specifically described herein.

What is claimed is:

1. A spacer for heat exchangers comprising:

a plate for forming and maintaining a first passage and a second passage which carry out heat exchange therebetween, the plate made of a mixture of a fibrous material having a softening point, a resin material having a lower softening point than the fibrous material, and a paper material.

2. The spacer according to claim 1, wherein the fibrous material is made of cellulose fibers and the resin material is made of polyester or polyolefin.

3. The spacer according to claim 1, wherein the plate has at least one side formed with a resin coating.

4. The spacer according to claim 1, wherein the fibrous material is made of glass fibers and the resin material is made of polyester or polyolefin.

5. The spacer according to claim 1, wherein the fibrous material is made of metallic fibers and the resin material is made of polyester or polyolefin.

6. An element for heat exchangers comprising:

a spacer for forming and maintaining a first passage and a second passage which carry out heat exchange therebetween, the spacer made of a mixture of a fibrous material having a softening point, a resin material having a lower softening point than the fibrous material, and a paper material; and a partition for separating the first passage and the second passage and carrying out heat exchange therebetween, the partition being jointed to the spacer with softened resin material.

7. The element according to claim 6, wherein the fibrous material is made of cellulose fibers and the resin material is made of polyester or polyolefin.

8. The element according to claim 6, wherein the spacer has at least one side formed with a resin coating.

9. The element according to claim 6, wherein the fibrous material is made of glass fibers and the resin material is made of polyester or polyolefin.

10. The element according to claim 6, wherein the fibrous material is made of metallic fibers and the resin material is made of polyester or polyolefin.

11. The element according to claim 6, wherein the partition is constructed by overlapping a moisture permeability film having a gas impermeability, and an unwoven fabric.

12. A heat exchanger comprising:

spacers for forming and maintaining a first passage and a second passage which carry out heat exchange therebetween, the spacers made of a mixture of a fibrous material having a softening point, a resin material having a lower softening point than the fibrous material, and a paper material; and partitions for separating the first passage and the second passage and carrying out heat exchange therebetween, the spacers and the partitions being layered.

13. The heat exchanger according to claim 12, wherein the fibrous material is made of cellulose fibers and the resin material is made of polyester or polyolefin.

14. The heat exchanger according to claim 12, wherein the spacers have at least one side formed with a resin coating.

15. The heat exchanger according to claim 12, wherein the fibrous material is made of glass fibers and the resin material is made of polyester or polyolefin.

16. The heat exchanger according to claim 12, wherein the fibrous material is made of metallic fibers and the resin material is made of polyester or polyolefin.

17. The heat exchanger according to claim 12, wherein the partitions are constructed by overlapping a moisture permeability film having a gas impermeability, and an unwoven fabric.

18. The heat exchanger according to claim 12, wherein the spacers are dealt with water repellent finish.

19. A heat exchanger according to claim 12, wherein the partitions are made of a gas impermeability film which is constituted by overlapping a porous material and a thin film having a gas impermeability.

20. A heat exchanger according to claim 12, wherein the partitions are made of a moisture permeability film which is constituted by overlapping a porous material and a thin film having a moisture permeability which selectively permits vapor to pass.

21. A heat exchanger according to claim 19, wherein the gas impermeability film of the partitions are constituted by overlapping a resinous film and unwoven fabric.

22. A heat exchanger according to claim 20, wherein the moisture permeability film of the partitions is a porous nonfibrous sheet with a thin film overlapped on one side thereof, the thin film being made of a water-insoluble hydrophilic polymer with a moisture permeability.

23. A heat exchanger according to claim 20, wherein the moisture permeability film of the partitions is a porous nonfibrous sheet with a thin film overlapped on one side thereof, the thin film being made of a water-insoluble hydrophilic polymer with a moisture permeability and the porous nonfibrous sheet having gas permeability base cloth overlapped on the other side.

24. A heat exchanger according to claim 20, wherein the moisture permeability film of the partitions has a three layer structure wherein a porous nonfibrous sheet has a thin film overlapped thereon, the thin film being made of a water-insoluble hydrophilic polymer with a moisture permeability, and the thin film has gas permeability base cloth overlapped thereon.

25. A heat exchanger according to claim 20, wherein the moisture permeability film of the partitions is a porous nonfibrous sheet with a thin film overlapped on one side thereof, the thin film being made of a water-insoluble hydrophilic polymer with a moisture permeability, and the thin film has gas permeability base cloth overlapped thereon.

26. A heat exchanger according to claim 22, wherein the porous nonfibrous sheet is made of polytetrafluoroethylene.

27. A heat exchanger according to claim 23, wherein the porous nonfibrous sheet is made of polytetrafluoroethylene.

28. A heat exchanger according to claim 24, wherein the porous nonfibrous sheet is made of polytetrafluoroethylene.

29. A heat exchanger according to claim 25, wherein the porous nonfibrous sheet is made of polytetrafluoroethylene.

30. A method of forming a heat exchanger, comprising the steps of:

forming a mixture of a fibrous material having a softening point, a resin material having a lower softening point than the fibrous material and a paper material;

sheeting the mixture to form a sheet material;

forming a plate having a first passage and a second passage for carrying out heat exchange therebetween from the sheet material.

31. The method according to claim 30, wherein the fibrous material is cellulose fibers.

32. The method according to claim 30, wherein the fibrous material is glass fibers.

33. The method according to claim 30, wherein the fibrous material is metallic fibers.

34. The method according to claim 30, further comprising the steps of:

heating the plate to a temperature which is lower than the softening point of the fibrous material and higher than the softening point of the resin material; and jointing a partition to the plate with softened resin material to separate the first passage and the second passage.

* * * * *